US006976447B2

(12) United States Patent
Spiegel

(10) Patent No.: US 6,976,447 B2
(45) **Date of Patent: *Dec. 20, 2005**

(54) FLAG HOLDER FOR REDUCING FRAYING OF FLAG

(76) Inventor: H. Jay Spiegel, P.O. Box 444, Mount Vernon, VA (US) 22121

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 716 days.

(21) Appl. No.: 10/144,987

(22) Filed: May 15, 2002

(65) Prior Publication Data

US 2003/0213425 A1 Nov. 20, 2003

(51) Int. Cl.[7] ..... G09F 17/00

(52) U.S. Cl. ..... 116/173; 116/28 R; 116/174; 40/591

(58) Field of Search ..... 116/173, 28 R, 116/209, 174; 40/591–592, 597, 602, 218

(56) References Cited

U.S. PATENT DOCUMENTS

| | | | | | |
|---|---|---|---|---|---|
| 433,124 | A | * | 7/1890 | Hall | 116/174 |
| 1,325,973 | A | * | 12/1919 | Aronson | 116/173 |
| 1,360,584 | A | * | 11/1920 | Rohrbaugh | 116/173 |
| 2,270,753 | A | * | 1/1942 | Fikes | 40/218 |
| 2,527,357 | A | * | 10/1950 | Donahey | 116/173 |
| 3,672,700 | A | * | 6/1972 | Marose | 280/150 R |
| 3,955,786 | A | * | 5/1976 | Duddy | 248/537 |
| 4,110,818 | A | * | 8/1978 | Hempsey | 362/32 |
| 4,144,833 | A | | 3/1979 | Newman, Sr. | |
| 4,558,862 | A | * | 12/1985 | Kelly | 273/34 R |
| 4,875,431 | A | * | 10/1989 | Dobosz | 116/173 |
| 4,918,896 | A | * | 4/1990 | Wiese | 52/632 |
| 4,934,972 | A | * | 6/1990 | Shumway et al. | 441/69 |
| 4,949,525 | A | * | 8/1990 | Weaver | 52/720 |
| 4,967,685 | A | | 11/1990 | Beck | |
| 5,335,621 | A | | 8/1994 | Willis et al. | |
| 5,495,821 | A | | 3/1996 | Brewer | |
| 5,509,371 | A | | 4/1996 | Phillips | |
| 5,522,342 | A | * | 6/1996 | Chen-Chao | 116/174 |
| 5,572,835 | A | * | 11/1996 | Atkins et al. | 52/111 |
| 5,697,321 | A | * | 12/1997 | Dobbins | 116/174 |
| 5,769,474 | A | * | 6/1998 | Moore | 294/19.1 |

(Continued)

FOREIGN PATENT DOCUMENTS

| | | | |
|---|---|---|---|
| DE | 4141688 | A * | 6/1993 |
| DE | 29717131 | U1 * | 11/1997 |

* cited by examiner

*Primary Examiner*—Christopher W. Fulton
*Assistant Examiner*—Tania Courson
(74) *Attorney, Agent, or Firm*—H. Jay Spiegel

(57) ABSTRACT

A flag holder designed to reduce the fraying of the trailing edge of a flag supports a flag with an upper fitting and a lower fitting. The upper fitting may be fixed with respect to the flagpole or, if desired, may rotate with respect to the flagpole. However, the upper fitting may not reciprocate with respect to the flag holder. The lower fitting may freely reciprocate with respect to the flagpole and, if desired, may be rotatable with respect to the flagpole. As soon as wind conditions exceed a desired threshold, the lower fitting begins to rise up the flagpole, moved by flexing of the flag, until it arrives at the location of the upper fitting, causing the body of the flag to assume an elongated generally U-shaped configuration which drastically reduces the snapping effect that would otherwise cause fraying of the downstream edge of the flag. As soon as wind conditions reduce, the lower fitting automatically lowers, causing the flag to be fully opened again.

22 Claims, 5 Drawing Sheets

U.S. PATENT DOCUMENTS 5,826,535 A * 10/1998 Shaw ..... 116/173
5,943,980 A 8/1999 Huang
5,961,087 A * 10/1999 Lee ..... 248/362
5,975,009 A 11/1999 Nihra et al.
6,010,107 A * 1/2000 Goldfarb ..... 248/512
6,059,241 A * 5/2000 Martone ..... 248/230.1
D427,108 S * 6/2000 Fisher et al. ..... D11/182
6,484,992 B1 * 11/2002 Svensson et al. ..... 248/320

FLAG HOLDER FOR REDUCING FRAYING OF FLAG

BACKGROUND OF THE INVENTION

The present invention relates to a flag holder for reducing fraying of flag. In the prior art, numerous ways of holding a flag on a flagpole are known. Some prior art devices permit the flag holder to rotate with respect to the flagpole to prevent the flag from winding up around the pole. Other devices include the use of weights to maintain tension between the support locations for the flag holder to maintain tension therebetween. Other devices include wind deflectors to minimize the snapping effect along the flag's downstream trailing edge.

This latter point is a focus of the present invention. When a flag is exposed to heavy wind conditions, in the case where the flag is mounted on a stationary flag pole, a snapping effect occurs which in a short period of time causes the fibers on the downstream edge to unravel. As explained in U.S. Pat. No. 4,967,685 to Beck, the U.S. Government generally expects a nylon or cotton flag to last approximately 90 days based upon daily usage before the trailing edge of the flag becomes too unraveled to use. Beck attempts to solve this problem by providing a wind deflector intended to deflect wind around the flag itself to reduce the so-called "snapping effect" and extend the time period before the unraveling of the trailing edge of the flag requires its replacement. The present invention is specifically designed to solve the problem of the unraveling of the distal edge of the flag but in a simpler manner than that which is proposed by Beck.

The following additional prior art is known to Applicant:

U.S. Pat. No. 5,335,621 to Willis et al. discloses a flag support system in which a weight is provided to create tension along the length of the flag in the vertical direction along the pole. Willis et al. also disclose acknowledged prior art consisting of an additional tethering mechanism, also including the use of a flag to maintain tension. The present invention differs from the teachings of Willis et al. and with regard to the prior art cited therein as contemplating a flag holder in which the lower attachment may freely slide with respect to the flagpole so that in high winds the flag is supported by two fittings adjacent one another to limit the degree of snapping of the flag that would otherwise occur.

U.S. Pat. No. 5,495,821 to Brewer discloses an anti-fouling tethering device for displaying flags which includes an attachment that may pivot with respect to its mount while permitting rotation with respect to the pole. The present invention differs from the teachings of Brewer as contemplating free sliding movement of the lower fitting with respect to the upper fitting along the flagpole.

U.S. Pat. No. 5,509,371 to Phillips discloses flag holding rings designed to tightly clamp about a flagpole. The present invention differs from the teachings of Phillips as contemplating flag holding fittings that encircle the flagpole but where the lower fitting may freely slide with respect to the flagpole.

U.S. Pat. No. 5,769,474 to Moore discloses a flag installer apparatus for utility poles including the appearance of a flag attached to a flagpole using loops. There is no teaching or suggestion by Moore that those loops will permit the lower loop to slide along the pole with respect to the upper loop.

U.S. Pat. No. 5,943,980 to Huang discloses a banner connecting apparatus of a flagpole that allows the flag to freely rotate with respect to the pole to prevent winding of the flag around the pole. Huang specifically includes a sleeve that precludes the holding devices from converging toward one another. By contrast, the present invention contemplates the ability for the lower holder to converge toward the upper holder for the reasons set forth above.

U.S. Pat. No. 5,975,009 to Nihra et al. discloses a flag retaining mechanism including clips designed to tightly frictionally engage a flagpole while allowing rotation with respect thereto. There is no teaching or suggestion that the clips of Nihra et al. may slide along the flagpole in the manner contemplated by the present invention.

SUMMARY OF THE INVENTION

The present invention relates to a flag holder for reducing fraying of a flag. It is equally applicable to banners and pennants. The present invention includes the following interrelated objects, aspects and features:

(1) The present invention consists of a flag holder designed to reduce the fraying of the trailing edge of a flag. The present invention contemplates supporting a flag with an upper fitting and a lower fitting. The upper fitting may be fixed with respect to the flagpole or, if desired, may rotate with respect thereto. However, the upper fitting may not reciprocate with respect to the flagpole.

(2) The lower fitting may freely reciprocate with respect to the flagpole and, if desired, may rotate with respect thereto.

(3) If desired, the lower fitting may include a wind deflector designed to facilitate raising of the lower fitting in severe weather conditions. However, Applicant has found that even without such a wind deflector, the lower fitting rises, carrying the lower corner of the flag therewith when the flag begins to snap in the presence of high wind conditions due to the flexing of the flag.

(4) The lower fitting is preferably made of a lightweight material and is not weighted in any way. Applicant has found that with such a lower fitting, the weight of the flag and the fitting are sufficient to cause the flag to maintain an open position with the lower fitting at its lowest possible extent based upon the edge of the flag adjacent the pole being extended to its full length. As soon as wind conditions exceed a desired threshold, caused, either by wind blowing on a stationary flagpole, or caused by a flagpole moving through the wind as mounted on a vehicle, the lower fitting begins to rise up the flagpole, moved by flexing of the flag, until it arrives at the location of the upper fitting, thereby causing the body of the flag to assume an elongated generally U-shaped configuration which drastically reduces the snapping effect that would otherwise cause fraying of the trailing edge of the flag. As soon as wind conditions reduce, either by slowing of the vehicle or lessening of the wind velocity for a stationary flagpole, or a combination of both for a flagpole mounted on a vehicle, the lower fitting automatically lowers, thereby causing the flag to be fully exposed again.

(5) When the flag is mounted on a vehicle and the wind is blowing in the same direction of movement of the vehicle, the flag will remain unfurled with the lower fitting at its lowest extent, presuming the relative difference between the wind speed and the vehicle speed are such that the difference does not exceed the desired threshold. When through intensifying of the wind or speeding up of the vehicle the threshold is exceeded, the lower fitting automatically rises toward the upper fitting to reduce the snapping effect.

(6) In one embodiment of the present invention, the lower fitting has a fixed diameter opening therethrough sized to allow easy sliding along the flagpole. In another embodiment, the lower fitting consists of a known clamping mechanism which is placed about the flagpole in a manner not contemplated by that clamping mechanism, to wit, so that the lower fitting loosely fits about the flagpole without clamping it to allow easy sliding. In a further embodiment, a protrusion on the lower fitting rides in a slot in the flagpole.

As such, it is a first object of the present invention to provide a flag holder for reducing fraying of a flag.

It is a further object of the present invention to provide such a device that allows the flag to adopt a new configuration responsive to wind conditions to reduce the snapping effect along the flag's downstream edge.

It is a further object of the present invention to provide such a device in which the upper holder for the flag is vertically fixed while the lower holder is freely vertically movable.

It is a still further object of the present invention to provide such a device where, if desired, the upper and lower holders may freely rotate with respect to the flagpole to which they are mounted.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
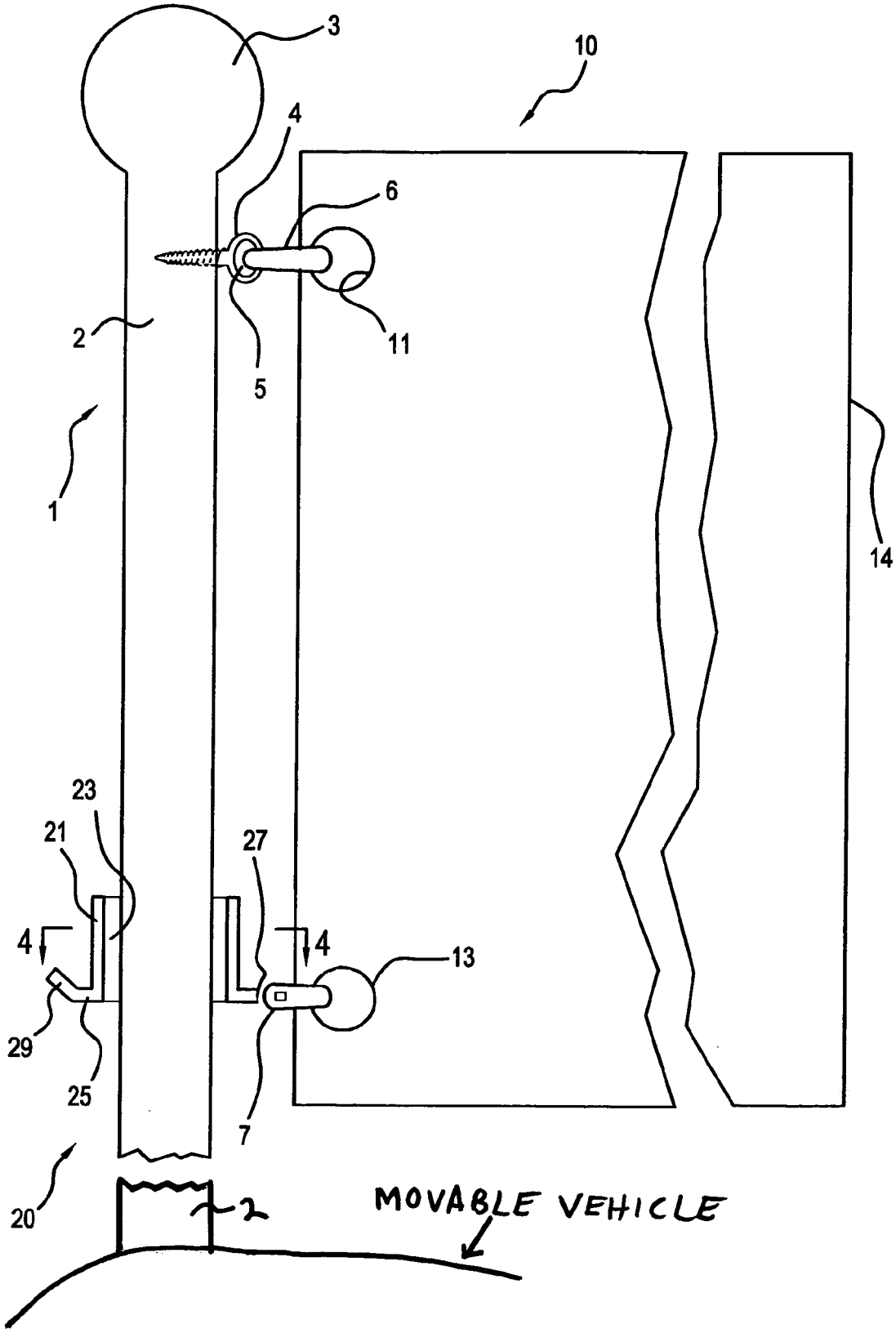
FIG. 1 shows a side view of a first embodiment of the present invention.

Reference is first made to FIG. 1 which shows a flagpole designated by the reference numeral 1 and including an elongated shaft 2 having an axis of elongation, a consistent outer configuration and a bulbous upper end 3. The shaft is schematically shown in FIG. 1 mounted on a movable vehicle. An upper fitting consists of an eyelet 4 threadably received within the shaft 2 and includes an opening 5 sized to receive a clip 6 designed to extend through a grommet 11 formed in a flag 10 or other banner or pennant. The flag 10 also includes a lower grommet 13 that receives the clip 7.

As should be understood from the above description, the eyelet is fixed in position with respect to the shaft 2 and may not reciprocate or rotate with respect to the shaft 2.

Figure 4:
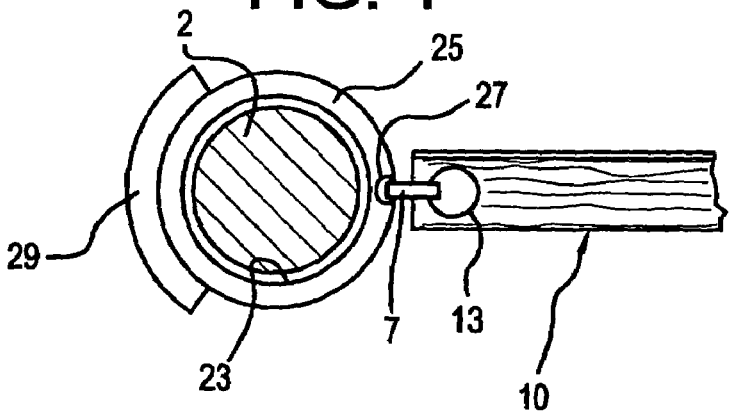
FIG. 4 shows a cross-sectional view along the line 4—4 of FIG. 1.

With reference now to FIGS. 1 and 4, the present invention includes, in one embodiment thereof, a lower fitting designated by the reference numeral 20 and including a sleeve 21 having an internal passageway 23 having dimensions defining a slight spacing between the sleeve 21 and the shaft or body 2 permitting the sleeve 21 to easily slide up and down over the outer periphery of the shaft 2. The lower fitting 20 includes an annular shoulder 25 having an opening 27 that, as best seen in FIG. 4, receives the clip 7 which also extends through the grommet 13 of the flag 10. If desired, the portion of the fitting 20 opposite the opening 27 may have a deflector 29 (see FIGS. 1 and 4) that extends part way about the circumference of the annulus 25. The deflector 29 may be provided, if desired, for a purpose to be described in greater detail hereinafter.

Figure 5:
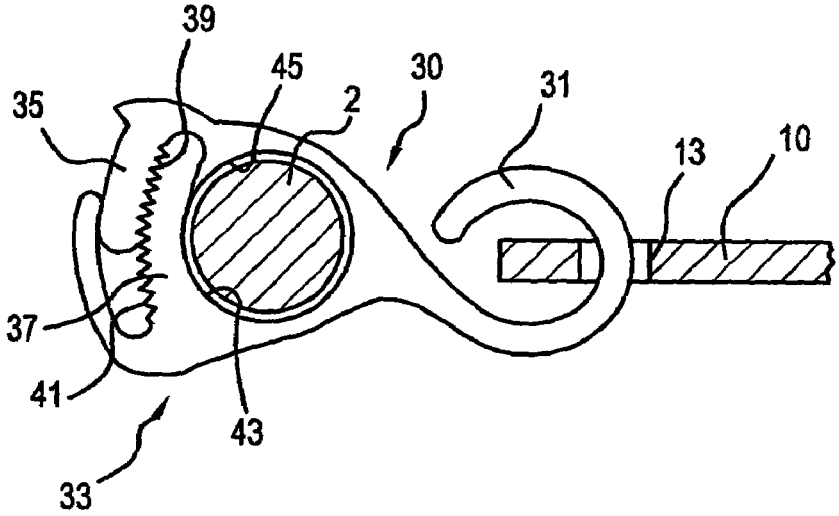
FIG. 5 shows an alternative construction for the lower holder of the present invention.

With reference now to FIG. 5, an alternative construction for the lower fitting is generally designated by the reference numeral 30 and comprises a clip having a hook 31 at one end designed to extend through the grommet 13 of the flag 10 and a clamping mechanism generally designated by the reference numeral 33 at the other end designed to encircle the shaft 2.

The clamping mechanism 33 includes two legs 35 and 37 having facing teeth 39 and 41, respectively, which are pointed in a direction such that they may be slid past one another when the legs 35 and 37 are squeezed in a direction of overlap, but which lock the legs 35 and 37 preventing them from being retracted. The flexibility of the device 30 permits the legs 35 and 37 to be uncoupled by sliding one leg or the other perpendicular to their directions of elongation (in a direction in or out of the paper in the view of FIG. 5) to disengage the teeth 39 and 41. As the clamping mechanism 33 is designed, it is intended that the legs 35 and 37 be squeezed together until the surfaces 43 and 45 tightly clamp about the periphery of a shaft preventing any rotation or reciprocation with respect thereto. As the clamping mechanism 33 is used in accordance with the teachings of the present invention, it is oriented as shown in FIG. 5 with the surfaces 43 and 45 clearly spaced from the periphery of the shaft 2 so that the fitting 30 may freely reciprocate up and down the shaft in accordance with the teachings of the present invention.

Figure 6:
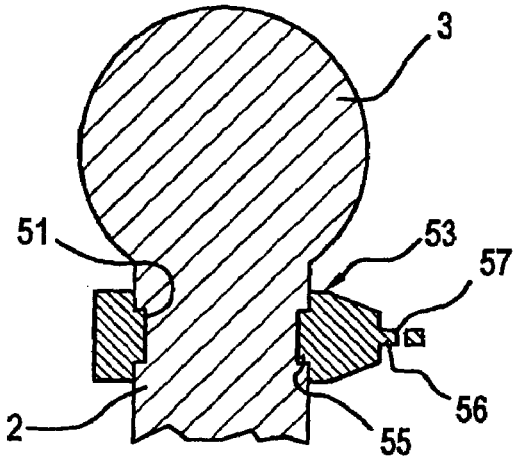
FIG. 6 shows an alternative construction for the upper holder of the present invention.

With reference now to FIG. 6, an alternative construction in place of the eyelet 4 (upper fitting) is shown. In the alternative construction, an annular recess 51 is formed in the shaft and a fitting 53 is installed with an annular inwardly extending protrusion 55 loosely seated in the recess 51 so that the fitting 53 may freely rotate with respect to the shaft 2 so that that ability to rotate in conjunction with the rotatability of the fitting 20 or 30 precludes a flag, banner or pennant from winding itself about the periphery of the shaft 2. The recess and protrusion may be reversed. The interaction of the recess 51 and protrusion 55 precludes the fitting 53 from reciprocating up or down with respect to the shaft 2. An opening 57 is formed in a tang 56 extending out from the fitting 53 in one direction. A clip such as the clip 6 may be used to couple the fitting 53 to a grommet of a flag pennant or banner as should now be clearly understood.

With reference now to FIGS. 1, 2, 3 and 7, the operation of the present invention will now be explained. Although FIGS. 1, 2 and 3 solely show the fitting 20, as should be understood, the same operation will accrue if the fitting 30 is substituted therefor.

FIG. 1 shows the configuration of the fitting 20 and the flag 10 when (1) the flagpole 1 is stationary or (2) moving below a threshold speed of, for example, 10 to 15 miles per hour or when the wind is blowing less than that speed or some combination of both.

Figure 2:
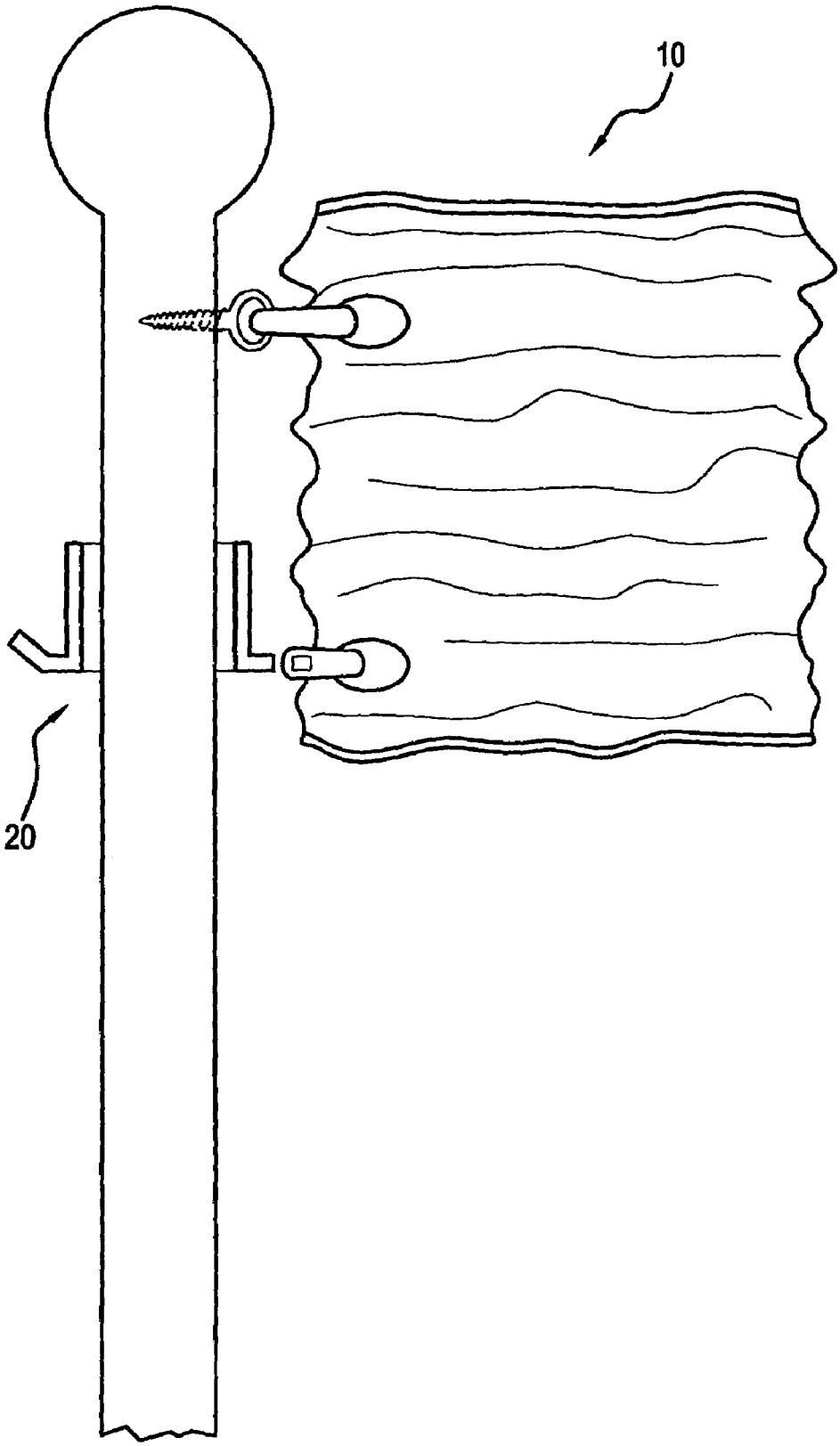
FIG. 2 shows the embodiment of FIG. 1 showing the motion of the lower holder responsive to increased wind speed.
Figure 3:
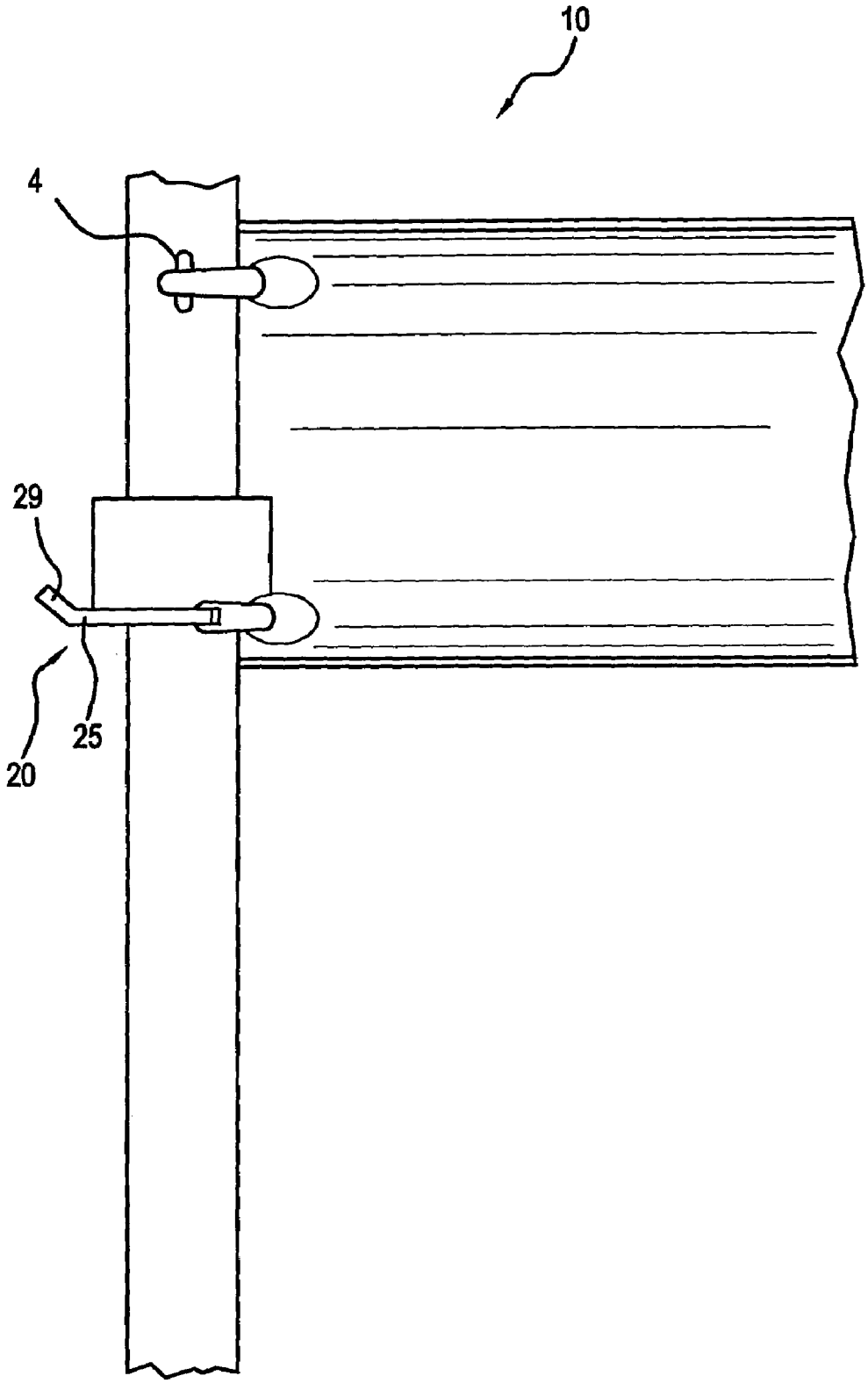
FIG. 3 shows the configuration of FIG. 2 but rotated 90° to look at the flag from its distal edge.

The present invention operates in the manner to be described below where the wind speed with respect to the flagpole 1 exceeds a threshold such as, for example, 10–15 miles per hour regardless of the combination of circumstances which cause that relative speed to occur. As the relative speed between the wind and the flagpole 1 increases, as is well known, the flag 10 will begin to flap, and as the wind speed increases, the flapping becomes more vigorous beginning to cause a snapping effect along the trailing edge 14 (FIG. 1) which will eventually result in fraying and unraveling of that edge that would normally require the flag to be replaced. As this phenomenon occurs, the flapping and flexing of the flag causes the fitting 20 to begin to ride up the shaft 2 toward the eyelet 4 as is seen in FIGS. 2 and 3. If the relative speed between the wind and the shaft 2 gets high enough, eventually, the fitting 20 will rise to a level where its further movement will be stopped by the eyelet 4. As should be understood from FIGS. 3 and 7, as the flag rises, it begins to adopt an elongated U-shaped configuration (see FIG. 7, in particular) which allows the wind to blow straight through like a chute. This configuration of the flag dramatically reduces the flapping and snapping of the flag and severely diminishes the snapping effect that normally occurs on the downstream edge of the flag.

Figure 7:
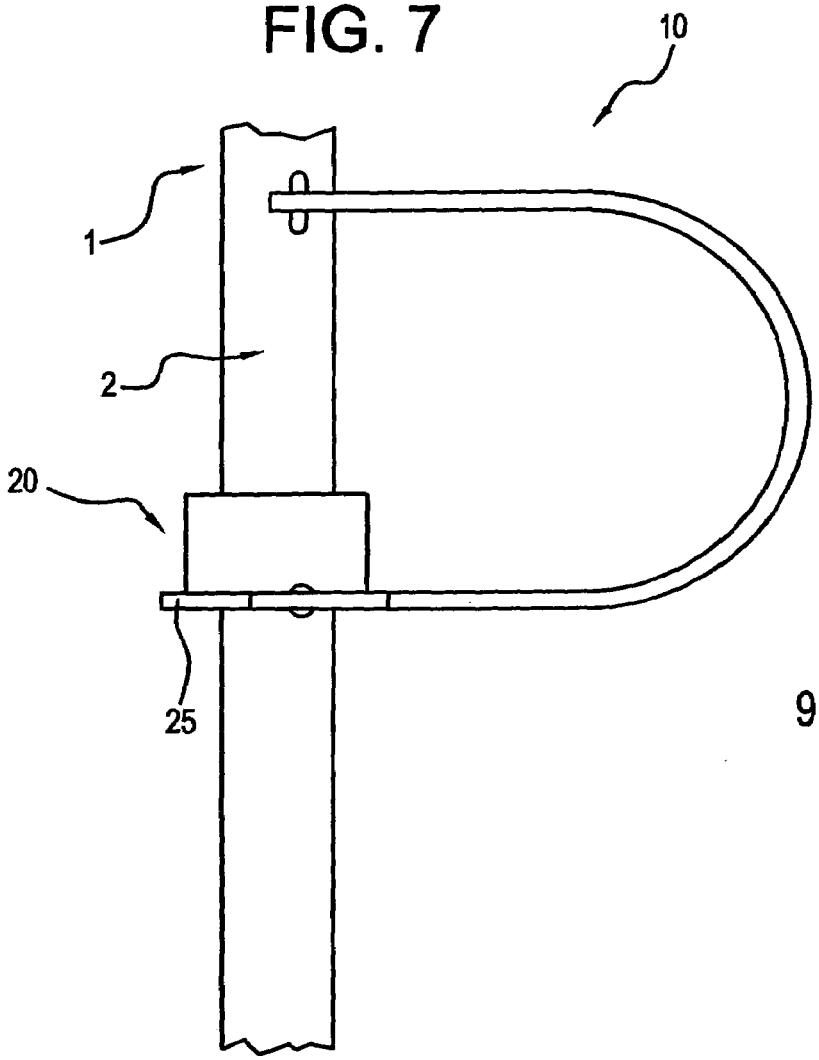
FIG. 7 shows the configuration of FIGS. 2 and 3 but looking at the flag on end with the shaft therebehind.

FIG. 7 shows in detail the U-shaped configuration that the flag achieves at this point. As the relative wind speed as compared to the position of the shaft 2 diminishes below the threshold, the fitting 20 begins to slowly lower downward until it arrives at its position as shown in FIG. 1, whereupon the flag is in the configuration shown, flying to its full area.

In the fitting 20, a deflector 29 is shown which has the effect of enhancing the upward movement of the fitting 20 at a lower relative wind speed than is the case when the deflector 29 is omitted. The deflector 29 is absolutely unnecessary to facilitate the movements of the fitting 20 described above because, in operation, without the deflector 29, the fitting 20 is pulled upwardly by the movements of the flag 10, under the influence of wind velocity, toward the configuration shown in FIGS. 2, 3 and 7.

Figure 8:
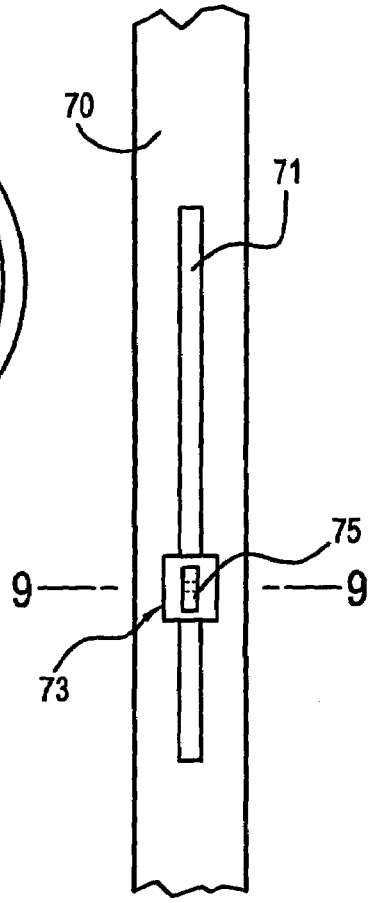
FIG. 8 shows a front view of a further alternative for the lower fitting showing a guide slot in the flagpole.
Figure 9:
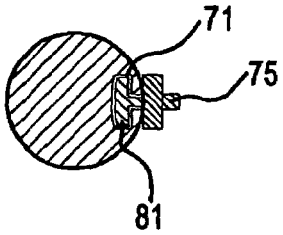
FIG. 9 shows a cross-sectional view along the line 9—9 of FIG. 8.
Figure 10:
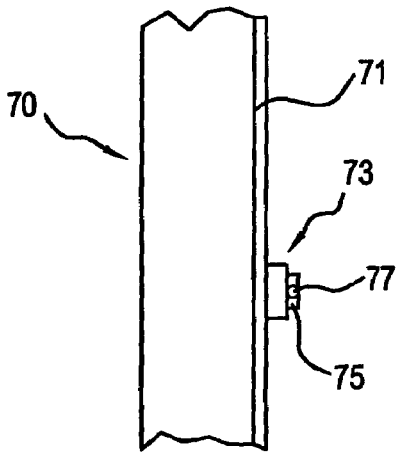
FIG. 10 shows a side view of the structure shown in FIG. 8.

With reference now to FIGS. 8–10, a third embodiment of the lower fitting is explained. First, with reference to FIGS. 8 and 10, the flagpole 70 has an elongated slot 71 that includes the internal configuration seen in FIG. 9. The lower fitting 73 includes a portion 75 having an opening 77 therethrough (FIG. 10) that permits coupling to a grommet or other attachment means on a flag. The fitting 73 includes a rearwardly facing T-shaped protrusion 81 that loosely fits within the recess 71 as best seen in FIG. 9. The interaction between the protrusion 81 and the recess 71 including the slight spacing therebetween, clearly shown in FIG. 9, permits the lower fitting 73 to easily slide upwardly and downwardly in the view of FIG. 8 parallel to the axis of elongation of the flagpole 70 while precluding the lower fitting 73 from rotating about the periphery of the flagpole 70.

As should be understood, the fitting 73 operates equally effectively to the fittings 20 and 30, although the difference is that the fittings 20 and 30 may rotate about the periphery of the flagpole while the fitting 73 may not.

When either the fitting 20 or 30 is employed and the eyelet 4 is employed, there is a limit to the amount of rotation the fitting 20 or 30 may carry out with respect to the shaft 2. Where the fitting 53 is substituted for the eyelet 4, and either the lower fitting 20 or 30 is employed, the flag 10 may freely rotate about the shaft without wrapping therearound. Based upon the intended environment of use of the present invention, mainly on moving vehicles, wrapping of the flag 10 about the pole 1 is not a major concern. However, where this is a major concern, the fitting 53 may be used with either of the fittings 20 or 30 to both accomplish the goals of the present invention while also precluding the flag from wrapping itself about the shaft 2.

As such, the present invention has been disclosed in terms of preferred embodiments thereof which fulfill each and every one of the objects of the present invention as set forth hereinabove, and provide a new and useful flag holder for reducing fraying of a flag of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. In a moving vehicle, the improvement comprising a flag holder, comprising:

a) an upper fitting and a lower fitting, each including coupling means for coupling to a separate attachment location on a leading edge of a flag, banner or pennant, said leading edge having a length;

b) a flagpole mounted on said vehicle and having an axis of elongation;

c) said upper fitting mounted on said flagpole with an upper mounting, said upper mounting precluding said upper fitting from moving along said axis of elongation of said flagpole;

d) said lower fitting being mounted on said flagpole with a lower mounting permitting movement of said lower fitting along said flagpole toward said upper fitting, said lower mounting constraining said lower fitting to move solely linearly parallel to said axis of elongation while precluding said lower fitting from rotating about said axis of elongation;

e) whereby, when said upper and lower fittings are coupled to separate attachment locations on said flag, banner or pennant, and said vehicle is moving, relative wind speed above a desired threshold with respect to said flagpole causes said lower fitting to move up said flagpole toward said upper fitting, thereby causing said flag, banner or pennant to adopt a non-planar elongated U-shaped configuration reducing snapping of a trailing edge thereof remote from said flagpole.

2. The flag holder of claim 1, wherein said upper mounting permits rotation of said upper fitting about a periphery of said flagpole.

3. The flag holder of claim 2, wherein said upper mounting includes an annular recess in one of said flagpole and upper fitting, and a protrusion in the other of said upper fitting and flagpole.

4. The flag holder of claim 3, wherein said recess is in said flagpole.

5. The flag holder of claim 1, wherein said upper mounting precludes rotation of said upper fitting about a periphery of said flagpole.

6. The flag holder of claim 5, wherein said upper mounting includes a threaded recess in said flagpole and a threaded protrusion on said upper fitting threadably received in said threaded recess.

7. The flag holder of claim 6, wherein said upper fitting comprises a threaded eyelet.

8. The flag holder of claim 1, wherein said flagpole has an elongated slot along said axis of elongation and said lower fitting has a protrusion received in said slot and constrained to move along said slot.

9. A flag holder mounted on a moving vehicle having a flagpole mounted thereon, said flagpole having an axis of elongation, said flag holder comprising:

a) an upper fitting and a lower fitting, each including coupling means for coupling to a separate attachment location on a leading edge of a flag, banner or pennant, said leading edge having a length;

b) said upper fitting being fixedly mounted on said flagpole with an upper mounting, said upper mounting precluding said upper fitting from moving with respect to said flagpole;

c) said lower fitting being mounted on said flagpole with a lower mounting permitting movement of said lower fitting along said flagpole toward said upper fitting, said lower mounting constraining said lower fitting to move solely linearly parallel to said axis of elongation while precluding said lower fitting from rotating about said axis of elongation;

d) whereby, said upper and lower fittings are coupled to separate attachment locations on said flag, banner or pennant, so that with said vehicle moving and relative wind speed being above a desired threshold with respect to a position of said flagpole, said lower fitting moves up said flagpole toward said upper fitting, thereby causing said flag, banner or pennant to adopt an elongated U-shaped non-planar configuration reducing snapping of a trailing edge thereof remote from said flagpole;

e) said upper mounting including a threaded recess in said flagpole and a threaded protrusion on said upper fitting threadably received in said threaded recess.

10. The flag holder of claim 9, wherein said flagpole has an elongated slot along said axis of elongation and said lower fitting has a protrusion received in said slot and constrained to move along said slot.

11. The flag holder of claim 9, wherein said upper fitting comprises a threaded eyelet.

12. A method of reducing snapping of a trailing edge of a flag, banner or pennant, including the steps of:

a) mounting a flagpole having an axis of elongation on a movable vehicle;

b) mounting an upper fitting on said flagpole, such that said upper fitting is constrained from moving along said axis of elongation;

c) mounting a lower fitting on said flagpole, such that said lower fitting is free to move along said flagpole toward said upper fitting, said lower mounting constraining said lower fitting to move solely linearly parallel to said axis of elongation while precluding said lower fitting from rotating about said axis of elongation;

d) providing a flag, banner or pennant having a leading edge with upper and lower attachment locations thereon, and said trailing edge, said leading edge having a length;

e) attaching said upper attachment location to said upper fitting and said lower attachment location to said lower fitting;

f) moving said vehicle such that wind speed with respect to said flagpole increases to a level above a desired threshold, whereby said lower fitting moves up said flagpole toward said upper fitting, said flag, banner or pennant adopting a non-planar elongated U-shaped configuration reducing snapping of said trailing edge.

13. The method of claim 12, wherein said upper mounting permits rotation of said upper fitting about a periphery of said flagpole.

14. The method of claim 12, wherein said upper mounting precludes rotation of said upper fitting about a periphery of said flagpole.

15. The method of claim 12, wherein said lower mounting precludes rotation of said lower fitting about a periphery of said flagpole.

16. The method of claim 12, wherein said flagpole has an elongated slot along said axis of elongation and said lower fitting has a protrusion received in said slot and constrained to move along said slot.

17. In a moving vehicle, the improvement comprising a flag holder, comprising:

a) an upper fitting and a lower fitting, each including coupling means for coupling to a separate attachment location on a leading edge of a flag, banner or pennant;

b) a flagpole mounted on said vehicle and having a body, an axis of elongation and a length;

c) said upper fitting mounted on said flagpole with an upper mounting, said upper mounting precluding said upper fitting from moving along said axis of elongation of said flagpole;

d) said lower fitting being mounted on said flagpole body with a lower mounting permitting free movement of said lower fitting along said length of said flagpole toward said upper fitting, said lower mounting substantially precluding said lower fitting from lateral movement with respect to said axis of elongation, such lateral movement being limited by slight spacing between said lower mounting and said body, said slight spacing provided solely to facilitate said free movement;

e) whereby, when said upper and lower fittings are coupled to separate attachment locations on said flag, banner or pennant, and said vehicle is moving, relative wind speed above a desired threshold with respect to said flagpole causes said lower fitting to move up said flagpole toward said upper fitting, thereby causing said flag, banner or pennant to adopt a non-planar elongated U-shaped configuration reducing snapping of a trailing edge thereof remote from said flagpole.

18. The improvement of claim 17, wherein said upper mounting permits rotation, of said upper fitting about a periphery of said flagpole.

19. The improvement of claim 18, wherein said upper mounting includes an annular recess in one of said flagpole and upper fitting, and a protrusion in the other of said upper fitting and flagpole.

20. The improvement of claim 17, wherein said upper mounting precludes rotation of said upper fitting about a periphery of said flagpole.

21. The improvement of claim 20, wherein said upper mounting includes a threaded recess in said flagpole and a threaded protrusion on said upper fitting threadably received in said threaded recess.

22. The improvement of claim 17, wherein said flagpole has an elongated slot along said axis of elongation and said lower fitting has a protrusion received in said slot and constrained to move along said slot.

* * * * *